US009903052B2

(12) United States Patent
Wanjura et al.

(10) Patent No.: US 9,903,052 B2
(45) Date of Patent: Feb. 27, 2018

(54) LINT CLEANING SYSTEM FOR COTTON PROCESSING

(71) Applicants: The United States of America, as represented by the Secretary of Agriculture, Washington, DC (US); Bayer Cropscience, Idalou, TX (US)

(72) Inventors: John D. Wanjura, Tulia, TX (US); Craig Bednarz, Idalou, TX (US); Gregory A. Holt, Brownfield, TX (US); Mathew G. Pelletier, Idalou, TX (US)

(73) Assignees: The United States of America, as represented by The Secretary of Agriculture, Washington, DC (US); Bayer Cropscience LP, Research Triangle Park, NC (US)

( * ) Notice: Subject to any disclaimer, the term of this patent is extended or adjusted under 35 U.S.C. 154(b) by 378 days.

(21) Appl. No.: 14/689,293

(22) Filed: Apr. 17, 2015

(65) Prior Publication Data

US 2016/0305046 A1 Oct. 20, 2016

(51) Int. Cl.
*D01G 9/08* (2006.01)
*D01G 9/16* (2006.01)

(52) U.S. Cl.
CPC ..... *D01G 9/08* (2013.01); *D01G 9/16* (2013.01)

(58) Field of Classification Search
CPC ..... D01G 9/08; D01G 9/16; D01G 15/825; D01B 1/04
See application file for complete search history.

(56) References Cited

U.S. PATENT DOCUMENTS

| | | | | |
|---|---|---|---|---|
| 4,223,423 | A * | 9/1980 | Foerster | D01B 1/04 19/203 |
| 4,890,357 | A * | 1/1990 | Pinto | D01G 9/08 19/64.5 |
| 5,343,597 | A * | 9/1994 | Pinto | D01G 9/08 19/200 |
| 6,253,923 | B1 * | 7/2001 | Felkins | B07B 7/01 19/303 |
| 6,314,619 | B1 | 11/2001 | Vandergriff | |
| 6,477,734 | B1 * | 11/2002 | Gresser | D01G 9/08 15/309.1 |
| 2002/0166211 | A1 * | 11/2002 | Farber | D01G 9/06 19/200 |
| 2005/0217076 | A1 * | 10/2005 | Gvili | D01B 1/04 19/40 |

* cited by examiner

*Primary Examiner* — Shaun R Hurley
(74) *Attorney, Agent, or Firm* — John D. Fado; Robert D. Jones

(57) ABSTRACT

The lint cleaning system is a modified jet-type lint cleaner that includes a supplemental air control vane. The supplemental air control vane (among other things) segregates discharged foreign materials from incoming supplemental air so that the incoming supplemental air is not contaminated by the discharged materials. The current system also enables a user to more effectively control the volume and the pathway of supplemental air entering the cleaner and thereby optimize the function of the air cleaner.

17 Claims, 4 Drawing Sheets

LINT CLEANING SYSTEM FOR COTTON PROCESSING

FIELD OF THE INVENTION

The disclosed method and apparatus relates to an improvement to the current means of cleaning cotton lint. Specifically, the system described herein relates to an improved air ducting system that utilizes inertial energy to separate foreign material from cotton lint.

BACKGROUND OF THE INVENTION

Machine harvested cotton contains undesirable foreign material primarily comprised of soil particles, plant parts, various types of "trash", and other non-cotton materials. After harvesting, the unprocessed cotton (which includes commingled foreign material) is taken to a cotton gin for processing. One common device used for this process comprises a jet lint cleaner, which utilizes a high volume of air moving through a specialized ducting system at a high rate of speed. A sectional schematic of the conventional (prior art) jet cleaner 10, is shown in FIG. 1. The jet lint cleaner 10 separates the cotton lint from the denser foreign materials through an inertial separation process.

Specifically, as shown in FIG. 1, commingled lint and foreign materials are conveyed into the jet lint cleaner 10 by an incoming air stream (schematically represented by the arrow 12). The incoming air stream 12 is drawn through an incoming duct 14 by a suction means (preferably a fan) that is that is in communication with the outgoing duct 16. As the air stream 12 approaches a discharge aperture 18, the velocity of the air stream 12 increases as a result of the decrease in the cross-sectional area of the duct 14. The negative pressure created by the suction in the outgoing duct 16 results in supplemental air (schematically shown as the arrow 20) being drawn into the outgoing duct 16. The incoming air stream 12 (comprising commingled lint and foreign materials) meets the supplemental air 20 at the discharge aperture 18. At the discharge aperture 18, the cleaned cotton lint (schematically shown as the arrow 22) turns upward into the outgoing duct 16, as the foreign material (schematically shown as the arrow 24) having higher density than the lint 22, is discharged through the discharge aperture 18. The opening of the discharge aperture 18 can be increased or decreased by the adjustment mechanism 26 to provide more or less cleaning.

Although conventional jet lint cleaners 10 are reasonably effective, they are generally inefficient. For example, in the conventional cleaner shown in FIG. 1, the discharged foreign material 24 frequently mixes with the supplemental air 20 so that the incoming air is contaminated by the discharged material 24. Further, there is no management or control of the incoming air 20 so that there is no ability to control/optimize the flow path or flow volume of supplemental air 20 in response to changes in the nature and characteristics of the harvested cotton crop.

The need exists for a more efficient lint cleaning system. The system described herein enables a user to exert greater control over the supplemental air 20 entering the jet air cleaner 10. The system also enables a user to segregate the incoming supplemental 20 air from the foreign material 24 that is discharged from the system.

SUMMARY OF THE INVENTION

This disclosure is directed to a cotton processing system. The system is comprised of an incoming duct and an outgoing duct, with a foreign material discharge aperture positioned between the incoming duct and the outgoing duct. A supplemental air control vane is positioned adjacent the outgoing duct and the discharge aperture. The system is structured so that as an incoming airflow (which includes entrained cotton fibers and foreign material) flows from the incoming duct to the outgoing duct, the foreign material in the incoming airflow is ejected through the discharge aperture. Simultaneously, the supplemental air control vane controls a volume and a pathway of supplemental air entering the system through the discharge aperture.

This disclosure is further directed to a method of making a lint cleaning module. In accordance with the current method, an incoming air duct is connected to an outgoing air duct, with a foreign material discharge aperture positioned between the incoming duct and the outgoing duct. A supplemental air control vane is positioned adjacent to the discharge aperture. A supplemental air aperture is defined by the position of the supplemental air control vane. In operation, an incoming airflow flow with commingled cotton lint and foreign material is directed through the incoming duct. Foreign material in the incoming air flow is ejected out of the discharge duct and, simultaneously, the supplemental air control vane meters supplemental air into the system.

DETAILED DESCRIPTION OF PREFERRED EMBODIMENTS

Figure 1:
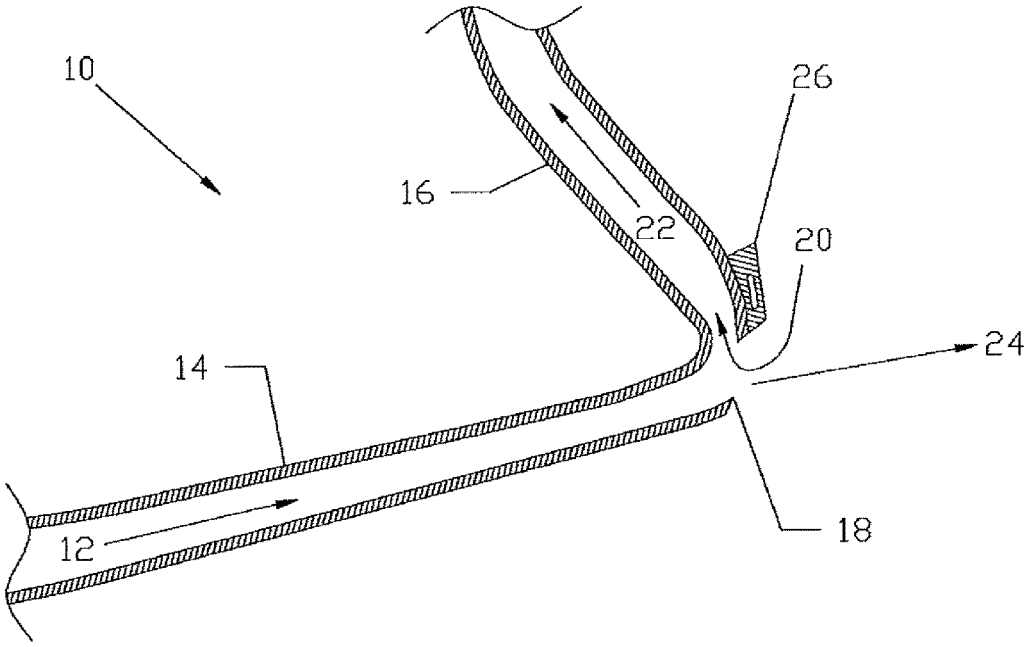
FIG. 1 (PRIOR ART)
FIG. 1 is a schematic view of a prior art jet lint cleaner 10.
Figure 2:
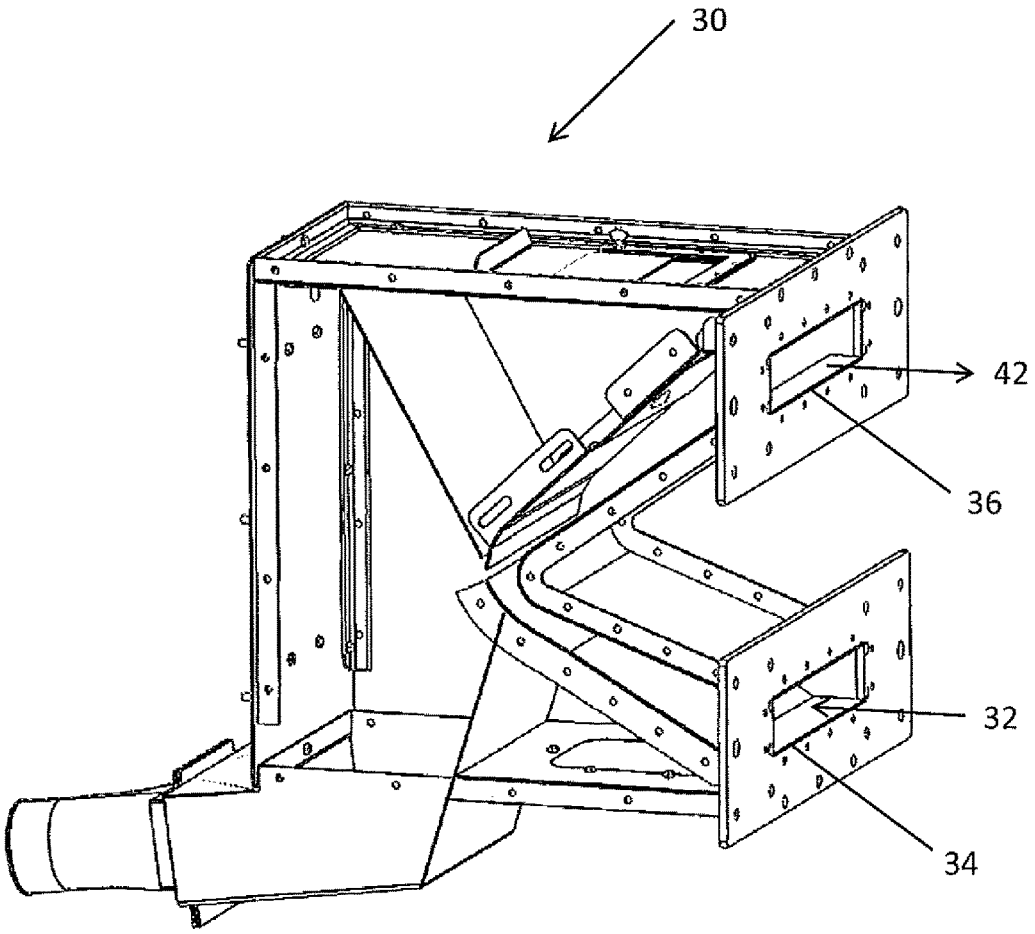
FIG. 2 is a top perspective view of the inventors' current lint cleaner 30. Note that the sides of the lint cleaner 30 are made of a transparent material to allow an operator to inspect the interior components of the cleaner 30.
Figure 3:
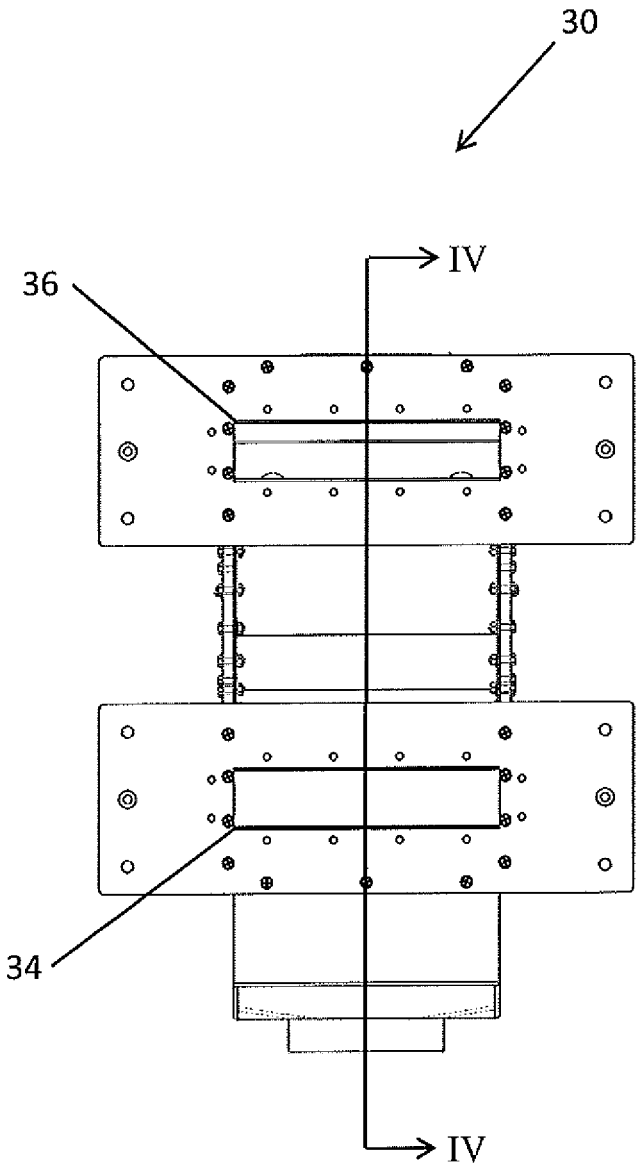
FIG. 3 is a profile view of the current lint cleaner 30 including the section line IV.
Figure 4:
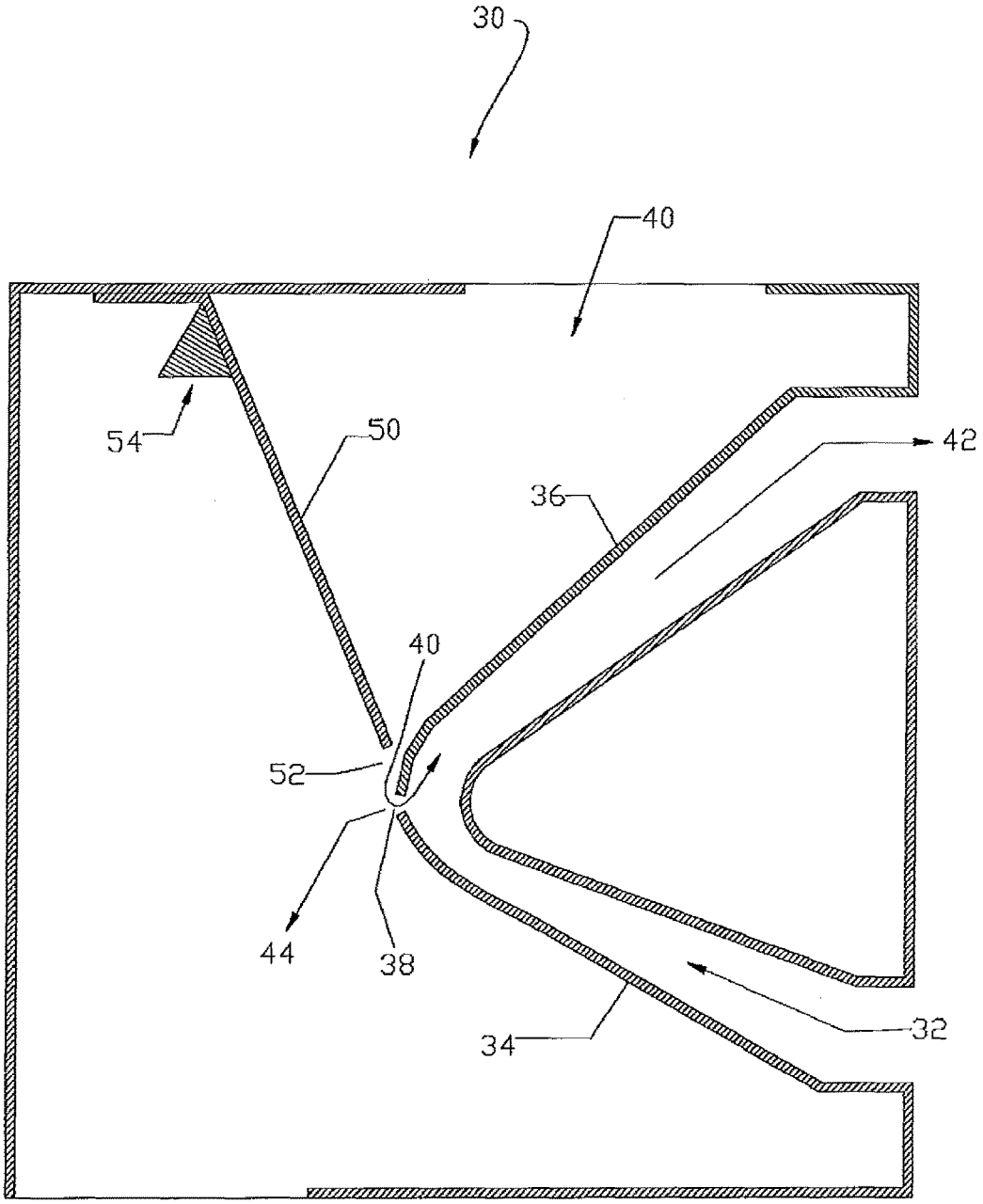
FIG. 4 is a side sectional schematic view of the current lint cleaner 30 along the section line IV shown in FIG. 3.

As generally shown in FIGS. 2-4, the method and apparatus described herein share some structural components with the prior art jet lint cleaner 10 shown in FIG. 1. However, the current cleaner 30 incorporates design features that significantly improve the efficiency and flexibility of the prior art jet cleaner system 10.

Specifically, as best shown in FIG. 4, commingled lint and foreign materials are entrained in an incoming air stream (schematically represented by the arrow 32) and are conveyed into the current cleaner 30. The incoming air stream 32 is drawn through an incoming duct 34 by a suction means (preferably a fan) that is that is in communication with the outgoing duct 36. As the air stream 32 approaches a discharge aperture 38, the velocity of the air stream 32 increases due to the decrease in the cross-sectional area of the duct 34.

The negative pressure created by the suction in the outgoing duct 36 results in supplemental air (schematically shown as the arrow 40) being drawn into the outgoing duct 36. The incoming air stream 32 (comprising commingled lint and foreign materials) meets the supplemental air 40 at the discharge aperture 38. At the discharge aperture 38, the cleaned cotton lint (schematically shown as the arrow 42) turns upward into the outgoing duct 36, as the foreign material (schematically shown as the arrow 44) having higher density than the lint 42, is discharged through the discharge aperture 38.

However, as best shown in FIG. 4, unlike the prior art jet cleaner 10, the inventors' current system 30 further comprises a supplemental air control vane 50. In the preferred embodiment, the air control vane 50 is comprised of at least one panel of planar metal sheet. The supplemental air control vane 50 defines a supplemental air aperture (a gap) 52 between the air control vane 50 and the outgoing duct 36.

As the supplemental air 40 flows through the supplemental air aperture 52 and then though the discharge aperture 38, the supplemental air creates a "high speed air curtain" at the discharge aperture 38. In the current air cleaner 30, the high speed air curtain deflects the discharged foreign materials 44 downwardly and away from the discharge aperture 38. The discharged foreign materials 44 are prevented from circulating around and contaminating the incoming supplemental air 40 by (among other things) the supplemental air vane 50.

For the purposes of this disclosure, a "high speed air curtain" comprises a supplemental air flow that has a flow velocity of at least 4,000 feet per minute and makes a change in direction (i.e. a turn) of greater than 90°, as schematically illustrated by the path of the supplemental air 40 in shown in FIG. 4. In the preferred embodiment, the supplemental air control vane 50 comprises a means for creating a high speed air curtain. In alternative embodiments, any means known in the art (i.e. pressurized incoming air, targeted air jets, etc.) may be used to create the high speed air curtain.

Essentially, in operation, the current lint cleaner 30 is similar to a conventional jet lint cleaner 10, however the current system 30 further comprises a supplemental air control vane 50. The supplemental air control vane 50 comprises a control surface that creates a high speed air curtain. In the preferred embodiment, the supplemental air control vane 50 changes position to control the volume and/or pathway of supplemental air 40 entering a system through the discharge aperture 38.

For the purposes of this disclosure, an "air control vane" comprises a variable control surface that controls an amount and a pathway of supplemental air entering a system. The position of the supplemental air control vane 50 also segregates the incoming supplemental air 40 source from the outgoing foreign materials 44, and thereby prevents contamination of the incoming supplemental air 40.

In the preferred embodiment, the size of the supplemental air aperture 52 is self-adjusting. Specifically, the air control vane 50 may be comprised of a semi-rigid material so that when the negative pressure (i.e. the suction) in the outgoing duct 36 reaches a threshold value, the air control vane 50 bends or otherwise deforms to increase the size of the supplemental air aperture 52, and thereby enables a greater volume of supplemental air 40 to enter the outgoing air duct 36.

In alternative embodiments, the size of the supplemental air aperture 52 may simply be manually adjusted by repositioning the air control vane 50 or by extending or retracting a portion (or all) of the air control vane 50 to effectively lengthen/shorten the air control vane 50 and thereby increase/decrease the size of the supplemental air aperture 52. Alternatively, the position of the upper portion of the outgoing duct 36 may be adjusted to effectively increase/decrease the size of the supplemental air aperture 52.

In further alternative embodiments, the size and position of the air control vane 50 may be mechanically or electrically controlled via a control system 54 shown schematically in FIG. 4. The control system 54 may comprise a hinge system wherein the air control vane 50 is held in place by mechanical springs or hydraulic shock absorber-type assemblies or the like. In this configuration, when the negative pressure exceeds a threshold value, the springs/hydraulic shocks compress (or expand) to increase the size of the supplemental air aperture 52 and thereby enable a greater/lesser volume of supplemental air 40 to enter the outgoing air duct 36.

In further alternative embodiments, the size of the supplemental air aperture 52 may be electronically controlled by an electrical solenoid, or an electrical and/or hydraulic motor controlling a screw-type drive, or by any motive means known in the art. The size of the supplemental air aperture 52 may also be varied as a part of a larger computer controlled system. A more comprehensive electronic control system includes an array of sensors and also controls the size of the discharge aperture 38 and the negative pressure present in the outgoing duct 36, and thereby optimizes the performance of the overall system.

Although FIG. 4 shows the incoming air flow 32 entering the bottom portion of the cleaner 30 and the outgoing air flow 42 exiting the outgoing the top portion, in alternative embodiments, the cleaner 30 may be inverted so that air flow comes into the top portion of the cleaner 30 and exits through the bottom of the cleaner 30. Essentially, the cleaner 30 functions effectively regardless of the spatial orientation of the cleaner module 30.

Additionally, as best shown in FIG. 2, a further advantage of the current system 30 is the system's relatively compact modular construction. In operation, two or more of the air cleaners 30 may be connected in series (i.e. stages), with each of the stages contributing to the cleaning process. This multi-stage cleaning process produces relatively clean lint that exhibits long fiber length. Long lint fibers are generally more desirable and command a higher price than shorter fibers.

By contrast, prior art cleaning processes that are used to produce similarly cleaned lint, frequently use multiple interlocking combs or continuously rotating saw cylinders which scrub fibers against sharpened stationary grid bars as a means of removing the foreign material from the cotton lint. Although these techniques effectively remove the foreign material, the cleaning mechanisms break some lint fibers so that only relatively short fibers remain after the cleaning process. The ability to produce clean long lint fibers is an important advantage of the current technology.

Further, the compact, modular construction of the current lint cleaners enables 30 an operator to quickly remove and replace any malfunctioning cleaner stage with minimal down time. The individual modular stages/cleaners are also easier to trouble-shoot and simpler to repair than non-modular systems with more complex and interconnected mechanisms. The current individual stages/cleaners have variable adjustment mechanisms, but essentially no continuously moving parts and therefore exhibit very little wear over time. Additionally, the current cleaners 30 offer improved worker safety relative to saw/grid or comb type cleaners due to the lack of continuously moving (frequently sharp) components. Unlike the prior art saw and comb-type cleaners, the lint cleaner described herein requires no sharpening, lubrication, or synchronization with cooperating components.

For at least the foregoing reasons, it is clear that the method and apparatus described herein provides an innovative air cleaner that may be used in cotton processing operations. The air cleaner may be modified in multiple ways and applied in various technological applications. The disclosed method and apparatus may be modified and customized as required by a specific operation or application, and the individual components may be modified and defined, as required, to achieve the desired result.

Although the materials of construction are not described, they may include a variety of compositions consistent with the function described herein. Such variations are not to be regarded as a departure from the spirit and scope of this disclosure, and all such modifications as would be obvious to one skilled in the art are intended to be included within the scope of the following claims.

What is claimed is:

1. A cotton processing system, the system comprising at least one lint cleaning module, each lint cleaning module comprising:

an incoming air duct connected to an outgoing air duct;

a foreign material discharge aperture positioned between the incoming duct and the outgoing duct; and, a supplemental air control vane positioned adjacent to the discharge aperture, the supplemental air control vane being positioned to segregate a supplemental air source from the discharged foreign material;

wherein, the system is structured so that as an incoming airflow flows from the incoming duct to the outgoing duct, foreign material in the incoming airflow is ejected through the discharge aperture, and simultaneously, the supplemental air control vane controls a volume and a pathway of supplemental air entering the system through the discharge aperture.

2. The system of claim 1 wherein the supplemental air control vane controls an amount of air entering the outgoing duct.

3. The system of claim 1 wherein the system further comprises a supplemental air aperture defined by a position of the supplemental air control vane, the supplemental air first entering the system through the supplemental air aperture and then through the discharge aperture.

4. The system of claim 3 wherein supplemental air aperture is also further defined by a position of a portion of the outgoing duct.

5. The system of claim 1 wherein the supplemental air control vane defines a plane that intersects a portion of the outgoing duct.

6. The system of claim 1 wherein the system is structured so that the supplemental air control vane creates a high speed air curtain that conforms to a portion of the outgoing duct and deflects the foreign material away from a source of the incoming supplemental air.

7. The system of claim 3 wherein, in operation, shape of the supplemental air control vane is deformable so that a size of the supplemental air aperture is variable based on deformation of the supplemental air control vane.

8. The system of claim 1 wherein, in operation, shape of the supplemental air control vane is deformable in proportion to a volume of supplemental air flow entering the outgoing duct.

9. The system of claim 1 wherein, in operation, shape of the supplemental air control vane is deformable in proportion to negative pressure in the outgoing duct.

10. The system of claim 3 wherein the system is structured so that a position of the air control vane and the outgoing duct are adjustable to vary a size of the supplemental air aperture.

11. The system of claim 1 wherein the system is structured so that a position of the air control vane is manually adjustable.

12. The system of claim 3 wherein the system is structured so that a size and/or position of the supplemental air aperture is controllable by an electronic controller.

13. The system of claim 1 wherein multiple lint cleaning modules are connected in series to further clean cotton lint.

14. The system of claim 1 wherein the system is structured so that the incoming air duct is positioned below the outgoing air duct.

15. A cotton processing system, the system comprising at least one lint cleaning module, each lint cleaning module comprising:

an incoming air duct connected to an outgoing air duct;

a foreign material discharge aperture positioned between the incoming duct and the outgoing duct; and, a means for creating a high speed air curtain forming around a portion of the discharge aperture;

wherein, the system is structured so that, as an incoming airflow flows from the incoming duct to the outgoing duct, foreign material in the incoming airflow is ejected through the discharge aperture, the high speed air curtain deflecting the foreign material and comprising a source of supplemental air for the system.

16. A method of making a lint cleaning module, the method comprising the steps of:

(a) providing an incoming air duct that is connected to an outgoing air duct;

(b) positioning a foreign material discharge aperture between the incoming duct and the outgoing duct;

(c) extending a supplemental air control vane to a position adjacent to the discharge aperture; and, (d) creating a supplemental air aperture that is defined by a position of the supplemental air control vane;

(e) directing an incoming airflow flow with commingled cotton lint and foreign material through the incoming duct;

(f) ejecting the foreign material in the incoming airflow out of the discharge aperture, and, (g) simultaneously utilizing the supplemental air control vane to meter supplemental air into the system and to segregate the supplemental air from the foreign material ejected out of the discharge aperture.

17. The method of claim 16 wherein, in step (g), the supplemental air control vane creates a high speed air curtain.

* * * * *